US009530632B2

(12) United States Patent
Kholomeev et al.

(10) Patent No.: US 9,530,632 B2
(45) Date of Patent: Dec. 27, 2016

(54) ION DETECTION SYSTEM AND METHOD

(71) Applicant: Thermo Fisher Scientific (Bremen) GmbH, Bremen (DE)

(72) Inventors: Alexander Kholomeev, Bremen (DE); Alexander Alekseevich Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/965,439

(22) Filed: Dec. 10, 2015

(65) Prior Publication Data

US 2016/0111267 A1 Apr. 21, 2016

Related U.S. Application Data

(63) Continuation of application No. 13/993,590, filed as application No. PCT/EP2011/072634 on Dec. 13, 2011, now Pat. No. 9,214,322.

(30) Foreign Application Priority Data

Dec. 17, 2010 (GB) ..... 1021405.4

(51) Int. Cl.

| | |
|---|---|
| ***H01J 49/00*** | (2006.01) |
| ***H01J 43/00*** | (2006.01) |
| ***H01J 49/02*** | (2006.01) |
| *H01J 49/40* | (2006.01) |

(52) U.S. Cl.

CPC ..... *H01J 49/0031* (2013.01); *H01J 43/00* (2013.01); *H01J 49/025* (2013.01); *H01J 49/40* (2013.01)

(58) Field of Classification Search

None

See application file for complete search history.

(56) References Cited

U.S. PATENT DOCUMENTS

| | | | |
|---|---|---|---|
| 2,772,364 | A | 11/1956 | Washburn |
| 2,780,728 | A | 2/1957 | Langmuir |
| 2,908,822 | A | 10/1959 | Cranberg |
| 3,235,725 | A | 2/1966 | Kendall |
| 3,435,207 | A | 3/1969 | Baldwin |

(Continued)

FOREIGN PATENT DOCUMENTS

| | | | |
|---|---|---|---|
| CN | 101789355 | A | 7/2010 |
| GB | 2486484 | B | 2/2013 |

(Continued)

*Primary Examiner* — Andrew Smyth

(74) *Attorney, Agent, or Firm* — David A. Schell

(57) ABSTRACT

A detection system and a method for detecting ions which have been separated in a time-of-flight (TOF) mass analyzer, comprising an amplifying arrangement for converting ions into packets of secondary particles and amplifying the packets of secondary particles, wherein the amplifying arrangement is arranged so that each packet of secondary particles produces at least a first output and a second output separated in time and so that during the delay between producing the first and second output the first output produced by a packet of secondary particles is used for modulating the second output produced by the same packet. An increased dynamic range of detection and protection of the detection system against intense ion pulses is thereby provided.

16 Claims, 4 Drawing Sheets

(56) References Cited

U.S. PATENT DOCUMENTS

| | | | | |
|---|---|---|---|---|
| 4,691,160 | A | 9/1987 | Ino | |
| 4,833,323 | A | 5/1989 | Scholze | |
| 5,712,480 | A | 1/1998 | Mason | |
| 5,981,946 | A | 11/1999 | Mason | |
| 6,037,586 | A | 3/2000 | Baril | |
| 6,408,946 | B1 | 6/2002 | Marshall et al. | |
| 6,674,068 | B1 * | 1/2004 | Kammei | H01J 49/025 250/282 |
| 6,787,723 | B2 | 9/2004 | Pronko et al. | |
| 6,831,280 | B2 | 12/2004 | Scherer | |
| 7,019,311 | B1 | 3/2006 | Horn | |
| 7,238,936 | B2 | 7/2007 | Okamura et al. | |
| 7,495,209 | B2 | 2/2009 | Baykut et al. | |
| 7,979,228 | B2 | 7/2011 | Zurbuchen et al. | |
| 8,183,524 | B2 | 5/2012 | Kenny et al. | |
| 8,203,120 | B2 | 6/2012 | Zewail | |
| 8,219,346 | B2 | 7/2012 | Zurbuchen et al. | |
| 8,247,769 | B2 | 8/2012 | Zewail | |
| 8,269,166 | B2 | 9/2012 | Okumura | |
| 8,389,929 | B2 | 3/2013 | Schoen et al. | |
| 8,440,970 | B2 | 5/2013 | Zewail | |
| 8,575,544 | B1 | 11/2013 | Kelly et al. | |
| 8,581,179 | B2 | 11/2013 | Franzen | |
| 8,686,359 | B2 | 4/2014 | Zewail | |
| 8,704,163 | B2 | 4/2014 | Schoen et al. | |
| 8,841,610 | B2 | 9/2014 | Schoen et al. | |
| 2002/0166960 | A1 | 11/2002 | Pronko et al. | |
| 2003/0111597 | A1 | 6/2003 | Gonin et al. | |
| 2003/0168590 | A1 | 9/2003 | Weiss et al. | |
| 2004/0056210 | A1 | 3/2004 | Scherer | |
| 2006/0284070 | A1 | 12/2006 | Baykut et al. | |
| 2007/0029473 | A1 * | 2/2007 | Verentchikov | H01J 49/406 250/281 |
| 2007/0278397 | A1 | 12/2007 | Bateman et al. | |
| 2008/0046194 | A1 | 2/2008 | Antonov et al. | |
| 2009/0125263 | A1 | 5/2009 | Zurbuchen et al. | |
| 2010/0051799 | A1 | 3/2010 | Makarov | |
| 2010/0108882 | A1 | 5/2010 | Zewail | |
| 2010/0108883 | A1 | 5/2010 | Zewail | |
| 2010/0148056 | A1 | 6/2010 | Kenny et al. | |
| 2010/0237238 | A1 | 9/2010 | Franzen | |
| 2011/0042565 | A1 | 2/2011 | Bateman et al. | |
| 2011/0215235 | A1 | 9/2011 | Schoen et al. | |
| 2011/0255380 | A1 | 10/2011 | Zurbuchen et al. | |
| 2011/0276526 | A1 | 11/2011 | Turbin et al. | |
| 2011/0284740 | A1 | 11/2011 | Okumura | |
| 2012/0312986 | A1 | 12/2012 | Zewail | |
| 2013/0112868 | A1 | 5/2013 | Schwieters et al. | |
| 2013/0175443 | A1 | 7/2013 | Schoen et al. | |
| 2013/0234023 | A1 | 9/2013 | Zewail | |
| 2013/0264474 | A1 | 10/2013 | Kholomeev et al. | |
| 2014/0158883 | A1 | 6/2014 | Zewail | |
| 2014/0224980 | A1 | 8/2014 | Schoen et al. | |

FOREIGN PATENT DOCUMENTS

| | | | |
|---|---|---|---|
| JP | 2004-533611 | | 11/2004 |
| WO | WO 97/33301 | A1 | 9/1997 |
| WO | WO 02/091425 | A2 | 11/2002 |
| WO | WO 2009/027252 | A2 | 3/2009 |
| WO | WO 2010/090286 | A1 | 8/2010 |
| WO | WO 2011/048060 | A2 | 4/2011 |
| WO | WO 2011/048061 | A2 | 4/2011 |
| WO | WO 2012/080443 | A1 | 6/2012 |

* cited by examiner

ION DETECTION SYSTEM AND METHOD

CROSS-REFERENCE TO RELATED APPLICATIONS

This application is a continuation under 35 U.S.C. §120 and claims the priority benefit of co-pending U.S. patent application Ser. No. 13/993,590 filed Jun. 12, 2013, which is the United States National Stage Application, under 35 U.S.C. 371, of International Application PCT/EP2011/072634 filed on Dec. 13, 2011. The disclosures of each of the foregoing applications are incorporated herein by reference.

FIELD OF THE INVENTION

This invention relates to an ion detection system and method for detecting ions. The system and method are useful for a time-of-flight mass spectrometer and thus the invention further relates to a mass spectrometer, particularly a time-of-flight mass spectrometer, comprising the ion detection system.

BACKGROUND

Time of flight (TOF) mass spectrometers are widely used to determine the mass to charge ratio (m/z) of ions on the basis of their flight time along a flight path. Ions are emitted from a pulsed ion source in the form of a short ion pulse and are directed along a prescribed flight path through an evacuated space to impinge upon or pass through an ion detector. The detector then provides an output to a data acquisition system. The ion source is arranged so that the ions leave the source with a constant kinetic energy and reach the detector after a time which depends upon their mass, more massive ions being slower. The ion pulse emitted from the source is thus separated along the flight path so that the ions arrive at the detector in a plurality of short ion packets, each packet comprising one or more ions of a particular mass (m/z) or restricted mass range and being typically a few nanoseconds (ns) long. The detector is therefore required to resolve ion packets on this timescale. The detector is typically of a secondary electron emission type so that the ion packets produce electron packets at the detector which get amplified by secondary electron emission by a factor typically of $10^5$-$10^8$. If the number of ions in the packets varies over a large range from one packet to another, then saturation of the detector and/or the data acquisition system can take place. If the gain of the detector is reduced to avoid saturation by the most intense ion packets then the detector may not be sensitive enough to detect the least intense ion packets. Thus, the dynamic range of the detector becomes compromised. Moreover, the detector life may be reduced by the effect of intense ion packets.

Currently, the following techniques are known for extending dynamic range of detection in TOF mass spectrometry.

In EP1215711, a method is described which involves switching the transmission of ions prior to extraction in subsequent scans. This method, however, reduces sensitivity and does not protect the detector from intense ion packets.

Another approach is on-the-fly modulation of ion packets following intermediate detection of the ion packets, as described for example in U.S. Pat. No. 6,674,068; and WO 2008/046594. This approach has the drawbacks that it requires an additional detector and more than one temporal focal point in the flight path, which is not feasible for some types of flight paths.

Splitting of the ions onto two or more detectors is described in U.S. Pat. No. 7,126,114 and US 2002/0175292. Such arrangements where the detectors have different gains and the detector outputs can be combined are described in U.S. Pat. No. 6,864,479 and U.S. Pat. No. 6,940,066. In addition to requiring two or more separate detectors, there is also no protection of the detector from intense ion packets in these arrangements.

Still further methodologies are known, including splitting of the electron packets produced by the ions between multiple anodes of similar dimensions (as described in U.S. Pat. No. 5,777,326) or different dimensions (as described in U.S. Pat. No. 4,691,160; U.S. Pat. No. 6,229,142; WO99/38191; U.S. Pat. No. 6,646,252); expansion of electron packets over a greater number of amplification channels (as described in U.S. Pat. No. 6,906,318 and U.S. Pat. No. 7,141,785); and detection of electron packets using two or more data acquisition channels with different gain.

Almost all of these techniques offer no protection of the detector from intense ion packets, an exception being the on-the-fly modulation of ion packets. However, an increase of ion transmission from the ion source through TOF analyzers from the current few percent in today's systems to potentially greater than fifty percent in future systems will mean that the ion flux onto the detector could go up to $>10^8$ ions/second. This would reduce lifetime of detector to unacceptable levels (e.g. a few hours) and therefore needs to be addressed.

On-the-fly modulation of detector gain is described in WO2006/014286 (U.S. Pat. No. 7,238,936) in relation to slower scanning mass spectrometers than TOF mass spectrometers where there is sufficient time for an intermediate stage of detection to disable a subsequent stage of detection and the speed of modulation is on the scale of milliseconds or microseconds. In such a prior art device, the rise time of an incoming ion signal (e.g. during a mass scan in a quadrupole, RF-ion trap or sector MS) is sufficiently long that a dynamic switching that acts on later arriving ions is sufficient to adequately modulate the signal. The detectors described therein would however not be suitable for detecting ions in a TOF mass spectrometer or faster scanning mass spectrometer where rise and fall times of the signals due to the incoming ion packets are typically of the order of a few nanoseconds (ns) long.

Accordingly, there remains a need to improve the detection of charged particles in TOF mass spectrometry. In view of the above background, the present invention has been made.

SUMMARY OF THE INVENTION

Accordingly to an aspect of the present invention there is provided a detection system for detecting ions comprising an amplifying arrangement for converting ions into packets of secondary particles and amplifying the packets of secondary particles, wherein the amplifying arrangement is arranged so that each packet of secondary particles produces at least a first output and a second output separated in time by a delay and so that during the delay between producing the first and second output the first output produced by a packet of secondary particles is used for modulating the second output produced by the same packet.

According to another aspect of the present invention there is provided a detection system for detecting ions comprising:

an amplifying arrangement for converting ions into packets of secondary particles and amplifying the packets;

wherein the amplifying arrangement is arranged so that each packet of secondary particles at least produces a first output at a first detector location of the amplifying arrangement and produces a second output at a second detector location of the amplifying arrangement downstream of the first detector location;

and wherein the amplifying arrangement is further arranged with a delay path between the first detector location and the second detector location sufficient that the first output produced by a packet of secondary particles is for controlling the gain of the second output produced by the same packet of secondary particles.

Accordingly to still another aspect of the present invention there is provided a method for detecting ions comprising:

converting ions into packets of secondary particles and amplifying the packets;

producing at least a first output and a second output from each packet of secondary particles, wherein a sufficient delay is provided between producing the first and second outputs that the first output produced by a packet of secondary particles is used for modulating the second output produced by the same packet.

The secondary particles may be selected from the group consisting of: electrons, secondary ions, and photons. The packets of secondary particles typically comprise packets of electrons (electron packets) which may optionally be converted into packets of photons before conversion back into electrons to produce the second output. The optional conversion into photons permits electrical de-coupling between the first and second outputs (i.e. the photon conversion provides optical coupling of thereby electrically de-coupled first and second outputs).

The present invention advantageously provides on-the-fly (i.e. dynamic) modulation of individual packets of secondary particles so that it is suitable for use as a TOF detector. The modulation can allow the detection system to keep both outputs below the limit of saturation and thus provide a significantly increased dynamic range. For example, the first output can be arranged such that it is always below a saturation level and modulation of the second output using the first output preferably ensures that the second output does not reach a saturation level or non-linear regime. Moreover, the detection system may be protected against the effects of intense ion packets, especially in embodiments wherein the modulation of the second output comprises attenuating the packet of secondary particles before the second output is produced. The invention thus may provide a detection system with an increased lifetime compared to prior art systems used in the same applications. The present invention may be implemented with a reduced cost and complexity compared to prior art detection systems for TOF, e.g. which utilise multiple channels and multiple gains.

The detection system is suitable for TOF mass spectrometry because it uses the same packet of secondary particles (i.e. produced from one ion packet) to produce first and second outputs but delays the packet sufficiently between producing the first and second outputs so that the first output can be used to modulate the second output. In other words, the invention is based upon providing a substantial transmission or flight path that separates the arrival of a packet at a first location where a first output is produced and a second location where a second output is produced by a time which is sufficient for modern high-speed electronics to provide on-the-fly modulation of packets of secondary particles.

As mentioned, the detection system is especially useful for detecting ions which have been separated in a time-of-flight (TOF) mass analyzer, i.e. the ions which are converted into electron packets are especially ions which have been separated in a time-of-flight (TOF) mass analyzer. Thus, it is preferred that the detected ions are ions which have been separated in a time-of-flight (TOF) mass analyzer. The ions accordingly may in particular be in the form of separated ion packets, so that each ion packet is converted to an electron packet. Herein an ion packet comprises one or more ions. The invention advantageously may provide a high-dynamic range detection system for time-of-flight (TOF) mass spectrometers. The TOF mass analyzer is preferably an orthogonal acceleration TOF mass analyzer or multi-reflection TOF mass analyzer. The TOF mass analyzer may be provided with or without ion storage.

Accordingly, in a further aspect, the invention provides a mass spectrometer comprising: an ion source for producing ions; a time-of-flight mass analyzer for separating the produced ions according to their time of flight through the mass analyzer; and a detection system according to the present invention for detecting the ions which have been separated by the mass analyzer.

However, the invention is not necessarily limited to use in a TOF mass spectrometer and may be used in other types of mass spectrometer for detecting ions, such as, for example, quadrupole, ion trap, and magnetic sector mass spectrometers. The invention is applicable to the detection of ion packets in which the length of ion packets is small, preferably substantially sub-microsecond (<1 μs).

Accordingly, in a further aspect of the present invention there is provided a detection system for detecting packets of ions, preferably in a mass spectrometer, comprising an amplifying arrangement for converting the packets of ions into packets of secondary particles and amplifying the packets of secondary particles, wherein the amplifying arrangement is arranged so that each packet of secondary particles produces at least a first output and a second output separated in time by a delay and so that during the delay between producing the first and second output the first output produced by a packet of secondary particles is used for modulating the second output produced by the same packet, wherein the packets of ions and/or the delay between the first and second outputs are substantially sub-microsecond in duration.

The mass spectrometer may comprise any suitable type of ion source such as any known in the art, e.g. MALDI, ESI, EI, API etc.

The delay line may be a delay line which delays electron packets (electronic delay) or photon packets (optical delay). The invention preferably comprises allowing the packets of secondary particles to propagate for a prolonged time (i.e. in the delay) without significant gain (e.g. with a gain factor within the range 100 or lower (especially 0.01 to 100), preferably 5 or lower (especially 0.5 to 5), and more preferably 1 or lower (especially 0.3 to 1)). The delay is preferably provided by a delay path, which is preferably a transmission or flight path for the packet of secondary particles, which provides a sufficiently long path in the amplifying arrangement from the first detector location to the second detector location where an output is produced that will be sent to a data acquisition system, so that the time taken to traverse the delay path by the packet of secondary particles is such that the packet can be sampled at the first detector location and an output produced therefrom (first output) that can be used to modulate the output (second output) produced from the same packet downstream at the second detector location. The delay path is preferably a path in which the packet of secondary particles undergoes substantially no amplification (preferably gain of about 1 or lower). Alternatively, the packet of secondary particles may undergo a low degree of amplification within the delay path (e.g. gain factor of about 100 or lower (e.g. 0.01 to 100), preferably 5 or lower (e.g. 0.5 to 5)). The delay path preferably comprises a flight tube especially where the packets are electron packets. Electron or ion optical lens or lenses may be provided within the flight tube to focus the electron packets as they travel through it. A suitable flight tube may comprise any of the following: (i) a zero- or low-electric field region, preferably with low or no gain (e.g. gain of 5 or lower, or 1 or lower), preferably with an electrostatic or magnetic lens or lenses to limit the size of the travelling electron packets, with electrons traversing this zero- or low-electric field region at a high energy (e.g. a few hundred to a few thousand eV, e.g. 100 to 10,000 eV); or (ii) a set of dynodes providing a low total gain (e.g. 5 or lower, e.g. 0.5 to 5), with delay occurring because of a lower speed of electron propagation across the dynodes.

The modulation of the second output may comprise adjusting the gain of the second output, e.g. by adjusting one or more voltages applied to the amplifying arrangement at the second detection location or by adjusting the gain of the second output further downstream, e.g. adjusting the gain of a pre-amplifier which amplifies the second output to avoid saturation of a data acquisition system. Preferably the modulation of the second output is implemented by using a gate, upstream of the second detection location through which the packets of secondary particles pass to reach the second detection location, wherein the gate is operable to adjust, preferably attenuate, the intensity of the packets which pass through the gate in response to a control signal based upon the first output. Thus, the gate control signal is preferably based upon the first output produced by a packet of secondary particles and is for operating the gate to adjust the intensity of the same packet as it passes through the gate thereby modulating the second output produced by the same packet. The gate is preferably located at the end of the delay path, i.e. the end nearest the second detection location. Preferably, as the packet travels along the delay path (e.g. a flight tube) the gate is simultaneously switched on at the end of the delay path (e.g. in response to a control signal based on the first output) to adjust the intensity of the packet as it passes the gate to the second amplification stage (described below) and/or second detection location.

The gate may comprise any arrangement of electron attenuation optics, e.g. any one or more electrodes or dynodes. The gate may comprise one or more electrodes (which in this context can be dynodes) which can be energised, i.e. by the control voltage applied thereto, to adjust a portion of the electron packet so that the adjusted portion is not amplified by the second amplification stage. For example one or more electrodes (which in this context can be dynodes) could be energised to deflect or repel a portion of the electron packet so that the deflected or repelled portion is not amplified by the second amplification stage. In some embodiments, the gate may comprise (at least) a pair of dynodes arranged in series wherein a first dynode of the pair has a plurality of openings arranged therein which allows a portion of the electrons in an electron packet to pass through to a second dynode of the pair (downstream of the first), whereby an electron packet becomes split into two streams, one stream proceeding from each of the first and second dynodes of the pair and wherein at least one of the streams is modulated in intensity based upon the first output before the streams are recombined to produce the second output. In some such embodiments, the gate may comprise (at least) a pair of dynodes arranged in series wherein a first dynode of the pair has a plurality of openings arranged therein which allows a portion of the electrons in an electron packet to pass through to a second dynode of the pair (downstream of the first), wherein the first dynode may be alone or part of a first dynode sequence and the second dynode may be alone or part of a second dynode sequence, wherein either (i) the first dynode allows a minority of electrons to pass through (low transmission) and the intensity of the secondary electrons arising from the first dynode or first dynode sequence are adjusted (attenuated) before being detected, or (ii) the first dynode allows a majority of electrons to pass through (high transmission) and the intensity of the secondary electrons arising from the second dynode or second dynode sequence are adjusted (attenuated) before being detected. The outputs from the first dynode or first dynode sequence and the second dynode or second dynode sequence are preferably combined to form the second output. In case (i), for example, a controllable voltage may be applied to the first dynode (or a dynode of the first dynode sequence) to adjust the number of secondary electrons it emits being detected. In case (ii), for example, a controllable voltage may be applied to the second dynode (or a dynode of the second dynode sequence) to adjust the number of secondary electrons it emits being detected.

It will be appreciated that numerous alternative types of gates can be implemented. An alternative gate may comprise an optical gate in the form of an optronic modulating device, i.e. an optical shutter for modulating the intensity of photon packets. Such embodiments may, for example, operate the gate at the end of an optical delay line provided after the first detection location and after the electron packet has been converted into a photon packet, the photon packet then being passed along the optical delay line. One example of an alternative type of gate of this type comprises a scintillator which lies downstream of the first stage of electron amplification (first detection location), optionally followed by a length (e.g. a few meters, e.g. 1 to 5 meters) of fibre optic (i.e. the optical delay), in turn followed by a Kerr cell controlled by the control signal based on the first output. The electronic circuitry for generating the control signal suitable for controlling the Kerr cell is described in more detail below. Then a photomultiplier downstream of the Kerr cell completes the detector and produce the second output. Thus, in operation, after the first detection location the electron packet produces a photon packet in the scintillator which is carried by the fibre optic to the Kerr cell which modulates the intensity of the photon packet which is transmitted to the photomultiplier. Kerr cells based on nanomaterials and/or MEMS devices may enable the operation voltage of the Kerr cell down to more acceptable levels, e.g. in the region of about 100 V. It can be seen therefore that not only direct modulation of the electron packet may be used but, as in the case of the Kerr cell for example, modulation of a photon packet into which the electron packet has been converted may be used to modulate the second output. An optical gate, such as the aforementioned Kerr Cell or another type of optronic modulating device, may be used in other configurations of the detection system than the one described employing an optical delay line. In another example, an optical gate may be used in combination with an electronic delay line. For example, the electron packets may be subject to delay, e.g. in the flight tube described herein, ("electronic delay") with the delayed electron packets being subject to conversion to photon packets, as described herein, downstream of the delay, followed by photon packet intensity modulation using an optical gate before the second output is produced.

The invention is not limited to having a single attenuation stage or a single gate for modulating the intensity of secondary particles, but the invention may include more than one stage of particle attenuation, e.g. more than one gate. The stages and/or gates may be arranged in a series. Such multiple stage of particle attenuation may each be independently employed with or without the particles producing an output (i.e. second output, and optionally further outputs etc.) after each stage of attenuation.

Preferably, the first output is produced and/or the first detector location is located after a first amplification stage of the amplifying arrangement. The first amplification stage preferably converts the ion packets into electron packets and further preferably amplifies the packets with a gain that keeps the first output below its saturation level. Preferably, the second output is produced and/or the second detector location is located after a second amplification stage of the amplifying arrangement. The second amplification stage preferably amplifies the packets with a gain that keeps the second output below its saturation level. The modulation of the second output using the first output is preferably for ensuring that the second output does not reach a saturation level or non-linear regime. For example, an attenuation of the packet of secondary particles before the second amplification stage may ensure that the packet is not subsequently amplified by the second amplification stage above the saturation level of the second output. The first amplification stage may comprise a microchannel plate (MCP), e.g. single or chevron pair MCP, or preferably a discrete dynode electron multiplier. In a simple case, the first amplification stage may comprise only a conversion dynode to convert and amplify ion packets into electron packets, i.e. with no further dynodes and/or MCP. The second amplification stage may comprise a similar arrangement to the first amplification stage, e.g. a microchannel plate (MCP), e.g. single or chevron pair MCP, or preferably a discrete dynode electron multiplier. More preferably, however, the second amplification stage comprises a series of discrete dynodes followed by an acceleration gap, a scintillator (preferably a fast scintillator) and a photon detector such as a photomultiplier (wherein a photon packet is ultimately converted back into an electron packet for detection at the second detection location). The latter arrangement is advantageous from the point of view of noise minimisation and enables a final detector anode to be kept at virtual ground potential. Thus, the amplifying arrangement may comprise only electron amplifying stages or may additionally include one or more intermediate stages of conversion of the electron packets into photons (photon conversion) before converting back again into electron packets (e.g. in a photomultiplier).

The delay or delay path preferably provides a delay time that is substantially sub-microsecond or <1 μs in duration. The delay or delay path preferably provides a delay time of at least 1 nanosecond (ns), more preferably 1 to 50 ns, preferably 1 to 10 ns. The delay is more preferably within any of the following ranges: 1-5 ns; 5-10 ns; 10-15 ns; 15-20 ns; 20-25 ns; 25-30 ns; 30-35 ns; 35-40 ns; 40-45 ns; 45-50 ns. The delay is still more preferably within any of the following ranges:

a) 1-5 ns
b) 5-10 ns;
b) 3-20 ns;
c) 5-50 ns.

From another viewpoint, the above time periods thus represent preferred time periods between the first and second outputs.

Where there is a first amplification stage and second amplification stage, the delay times above are the time, provided by the delay path, between a packet of secondary particles leaving the first amplification stage and entering the second amplification stage.

It will be appreciated that whilst only first and second outputs and corresponding first and second detector locations have been explicitly described herein the invention may comprise a third or further outputs from respective third or further detector locations. The third or further detector locations each may be independently located upstream, intermediate or downstream of the first and second detector locations. Any of the third or further outputs may be used either to modulate the second or another output and/or be fed to the data acquisition system.

The first detection location may comprise a first detection means such as a grid, or other means, to sample (e.g. sense or intercept) at least a portion of the electron packet and produce the first output, i.e. first detection signal. The first output is then preferably fed to control electronics which is adapted to produce a control signal in response to the first output, e.g. as a voltage pulse, to modulate the second output, preferably by operating the gate described above to adjust, preferably attenuate, the intensity of the same packet of secondary particles before the second output is produced. More preferably, the gate is operated by the control signal to adjust the intensity of the same packet of secondary particles before the second amplification stage. Thus, the gate is preferably also located before the second amplification stage or is part of or located within the second amplification stage. The control signal to operate the gate to adjust the secondary particle packet intensity is preferably generated only if the intensity of the packet at the first detector location (i.e. the first output) is above a threshold, e.g. a threshold corresponding to a linear operation of the second output and/or the data acquisition system. The factor by which the packet is attenuated by the gate (attenuation factor) is preferably fed to the data acquisition system which collects the second output so that the data acquisition system can multiply the second output by the attenuation factor which was applied to the packet. For example, if the packet intensity is attenuated by a factor of 3 (i.e. so that its intensity becomes a third of its un-attenuated intensity), the second output is multiplied by a factor of 3 subsequently.

The second output is preferably fed to a data acquisition system. Optionally, the first output may also be fed to the data acquisition system, e.g. to provide a low gain detection signal. The data acquisition system preferably comprises a pre-amplifier and an analog-to digital (A/D) converter to convert the second output and optionally first output to a digital signal. The data acquisition system preferably comprises data processing means, e.g. one or more dedicated processors such as an FPGA, GPU, etc. and/or one more general purpose computers, such as a PC etc. to process the digitised second output and optionally the digitised first output. The data acquisition system preferably multiplies the second output by the attenuation factor (if any) which was applied to the electron packet. In some embodiments, the respective data streams produced by the first output and second output (and optionally further outputs) may be merged by the data acquisition system, after optional data processing, to produce a merged mass spectrum. Methods for merging two or more data streams are known in the art of mass spectrometry, see for example WO 2008/08867 and U.S. Pat. No. 7,220,970. However, the present invention advantageously enables a single output (the second output) to operate over a wide dynamic range, without a necessity for merging the data stream from that output with a data stream from another output of different gain.

The data acquisition system, or another data processing system, may process the second output and optionally first output to produce data representative of a mass spectrum, which optionally may be stored and/or outputted, e.g. to a computer file, VDU or hard copy. The data processing of an output from a detection system produced by ion packets from a TOF or other mass analyzer to produce data representative of a mass spectrum is well known in the art. The invention may thus further comprise outputting data representative of a mass spectrum, e.g. as an output from the data acquisition system which has processed the second output and optionally first output to produce data representative of a mass spectrum. Correspondingly, the invention may further comprise an outputting device for outputting data representative of a mass spectrum. The outputting device may comprise an electronic display device (e.g. VDU screen) or printer.

Although especially useful for a TOF mass spectrometer, it will be appreciated that the invention may be used in other types of mass spectrometer where modulation of the output of the detection system is required to avoid reaching a saturation level. The other types of mass spectrometer may be, for example and without limitation thereto, a transmission quadrupole, ion trap (e.g. linear or 3D ion trap), electrostatic trap, orbital ion trap with image current detection (e.g. as described in Makarov, *Analytical Chemistry,* 2000, p. 1158), or magnetic sector mass spectrometer.

BRIEF DESCRIPTION OF THE FIGURES

In order to more fully understand the invention, various non-limiting examples of the invention will now be described with reference to the accompanying Figures in which.

DETAILED DESCRIPTION OF THE INVENTION

Figure 1:
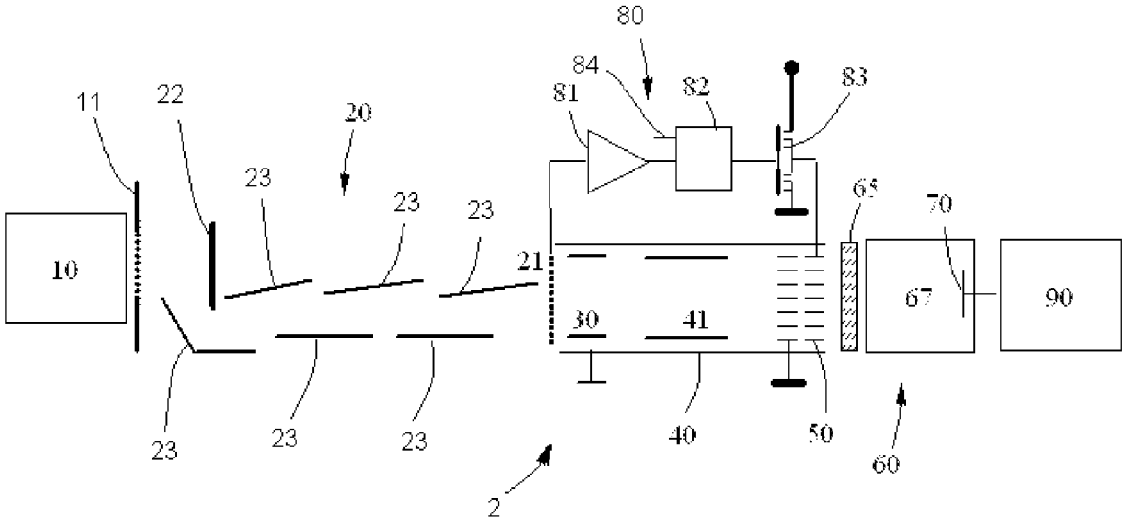
FIG. 1 shows schematically a first exemplary embodiment of a detection system and method according to the present invention.

Referring to FIG. 1, there is shown an embodiment of the present invention which comprises a TOF mass analyzer 10, which in use separates a short pulse of ions into a series of short ion packets according to the m/z of the ions by virtue of the different flight times of the ions through the mass analyzer as known in the art. The mass analyzer 10 may be a linear TOF, orthogonal acceleration TOF, reflectron TOF or multi-reflection TOF, with or without ion storage. It will be appreciated that a separate pulsed ion source (not shown) may be required for producing a short pulse of ions and introducing it into the TOF mass analyzer 10 for ion separation. The beam of separated ion packets exits the TOF mass analyzer 10 through anti-dynatron grid 11 and enter the detection system 2. Anti-dynatron grid 11 is biased at slightly negative potential relatively to the analyzer 10 so that electrons from scattered ions in the analyzer do not get detected. The ion packets first strike a conversion dynode 22 of a first amplification stage 20 which produces an electron packet from each ion packet which strikes the conversion dynode, the number electrons in each electron packet being in proportion to the number of ions in the ion packet which produced it. The first amplification stage 20 comprises an electron multiplier having a plurality of discrete dynodes 23 after the conversion dynode 22 which amplify the electron packets as they cascade along the dynodes 23. The first amplification stage 20 in an alternative embodiment may in place of, or in addition to, the discrete dynode electron multiplier shown, comprise a single or a chevron-pair micro-channel plate (MCP). The power supplies and voltages for first amplification stage 20 are not shown for simplicity as they are well known in the art.

The electron packets amplified by the first amplification stage 20 then pass through a grid 21 located at a first detection location, which samples a portion of each electron packet and produces a first output, which will be described in more detail below. Alternative detection means for sampling the beam of electron packets at the first detection location to the grid 21 could be used in other embodiments, e.g. image current detection (using fast FETs); direct readout from a dynode (which may or may not be capacitively or inductively coupled); a fast phosphor that intercepts a part of the beam (for electrical decoupling). The first output is connected to control electronics 80 which modulates the beam of electron packets, on the basis of the first output, by controlling one or more voltages applied to a gate 50 as described in more detail below.

After passing grid 21, the beam of electron packets next enter flight tube 40 designed to provide a sufficiently long flight path, also referred to as a delay line, for the electron packets before they are detected again at a second detection location downstream, as described in more detail below. The flight tube 40 could, as examples, comprise any of the following: a zero- or low-field region with electrons traversing this region at a high energy (e.g. a few hundred to a few thousand eV), or a set of dynodes with low total gain (e.g. 0.5 to 5), with delay occurring because of lower speed of electron propagation as the electrons cascade along the set of dynodes. In the embodiment shown, the electron packets pass extraction optics 30 which extract the ions into the flight tube 40, and one or more lenses 41 in the flight tube 40 which keep the beam of electron packets focused, i.e. limit the size of electron beam. The extraction optics 30 may comprise a set of grids or, preferably, a set of coaxial grid-less electrodes to which one or more voltages are applied. The one or more lenses 41 are optional however and may not be required in all embodiments. The one or more lenses 41 may be electrostatic or magnetic lenses. As examples, the one or more lenses 41 could comprise an Einzel lens; immersion lens; and/or a tube coaxial to the outer tube housing 40.

At the end of the flight tube 40 is situated gate 50, through which the beam of electron packets passes and which is adapted for modulating the intensity of the electron packets on a packet-by-packet basis as described in more detail below.

The gate 50 is followed by a second amplification stage 60 which comprises in the embodiment shown a fast scintillator 65 to convert the electrons in the electron packets into photons and a photomultiplier 67 to convert the photons in the photon packet back to electrons which are finally collected by detection anode 70 located at a second detection location which from the electron packets collected produces a second output from the detection system. Such an arrangement using a scintillator and photomultiplier allows a minimising of noise and enables the detection anode to be kept at virtual ground. Optionally, the second amplification stage 60 may comprise, in order, one or more, e.g. one to three, discrete dynodes followed by an acceleration gap and then the fast scintillator and photomultiplier as described. Further optionally, a vacuum window may be positioned between the scintillator and photomultiplier to enable easier access to the photomultiplier for replacement for example. In a further alternative embodiment, the second amplification stage 60 may comprise an amplification stage of a similar type to the first amplification stage, e.g. comprising a discrete dynode electron multiplier and/or a single or a chevron-pair microchannel plate. The power supplies and voltages for second amplification stage 60 are not shown for simplicity as they are well known in the art. Finally, the second output is passed to a data acquisition system 90 for data processing. The data acquisition system 90 digitises the second output and records and/or processes the digitised signal. The data acquisition system 90 preferably comprises a pre-amplifier with bandwidth above about 100 to 300 MHz followed by a 1 to 4 GHz ADC with 8 to 12 bit vertical dynamic range, on-board processing and input from control electronics 80, as described in more detail below. Optionally, in some embodiments, the data acquisition system 90 also receives and digitises the second output and records and/or processes the digitised signal.

The operation of the detection system and in particular the modulation of the second output will now be described in more detail. In operation, each electron packet which exits from the first amplification stage 20 is sampled by grid 21 which intercepts a portion of each electron packet thereby producing a first output from each packet in the form of an electrical signal which is sampled by control electronics 80 to which grid 21 is connected. The degree of electron packet amplification by the first amplification stage 20 is arranged such that the first output and the control electronics 80 do not reach a saturation level. The control electronics 80 is arranged to generate one or more voltages on gate 50 based on the first output from grid 21, preferably control electronics 80 is arranged to generate a voltage, typically a voltage pulse, on gate 50 whenever the intensity of an electron packet intercepted by grid 21 and thus magnitude of the first output (and thus intensity of the original ion packet) exceeds a threshold. The threshold typically corresponds to a limit of normal linear operation of the subsequent parts of the detection system (e.g. second amplification stage 60). For simplicity, the following description will refer to a voltage being applied to the gate 50 but it should be understood that this means one or more voltages. The voltage applied on gate 50 in this way acts to repel electrons approaching the gate and thereby attenuate the electron packet, i.e. reduce the packet intensity, which passes through the gate while the voltage is present on the gate. Thus, the intensity of the electron packet finally detected downstream at the second detection location and hence the second output becomes modulated by the voltage applied to the gate 50. If necessary, the electron packet could be completely blocked by gate 50 but usual operation is to allow the packet to pass but reduce the packet intensity to an acceptable level which does not cause saturation of the downstream detection system or data acquisition system. When no voltage is applied to gate 50 by the control electronics 80 (i.e. when intensity of the intercepted electron packet and thus first output, and hence incoming ion packet lies below the threshold, e.g. within the normal linear operation of the subsequent parts of the detection system and in particular the second output), the electron packet would not be attenuated and would proceed, un-modulated, through gate 50 to the second amplification stage 60 and hence to be detected by data acquisition system 90. In this way, the detection system, including the final (second) output, is always kept below a saturation level, preferably corresponding to the limit of linear operation of the second output, and is self-correcting to handle intense incoming ion packets. Moreover, the most sensitive, highest gain, part of the detection system can thereby be protected from the effects of intense incoming ion packets. In a preferred embodiment, the gate 50 is provided as a Bradbury-Nielsen gate made of 2 sets of parallel wires: the odd-numbered wires being connected to electronics 80 to receive the control voltage therefrom and even-numbered wires being connected to the flight tube potential. When the voltage pulse is applied from a switch 83 of the electronics, electrons get deflected in every gap between the wires so that most of them get absorbed on wires. A variation of such an arrangement is to have the wires connected to the electronics 80 in such a way that a number, typically most, of the gaps between the wires are activated to block electrons completely when the voltage pulse is applied from switch 83 and only every $n^{th}$ gap (e.g. every $10^{th}$) is not activated at all so that it transmits electrons. The control electronics 80 comprises an amplifier 81 and a comparator 82. The first output is amplified by amplifier 81 and is compared to a reference signal 84 in comparator 82, to thereby form a trigger pulse from comparator 82 when the first output exceeds a value relative to the reference. The trigger pulse activates voltage switch 83 to transmit a voltage pulse to control gate 50.

The operation of the gate 50 is synchronised with the travel of the electron packets through the delay line such that an electron packet produces a first output and the control electronics operate the gate based upon the first output from that electron packet to thereby appropriately modulate, or leave un-modulated, the intensity of that same electron packet as it passes through the gate. The delay provided should therefore be sufficient for the control electronics to operate the gate in time to modulate the same electron packet which produced the first output on which the gate control voltage is based. On the other hand such delay between the interception of the beam of electron packets to produce the first output and activating the gate 50 should be as short as possible as it defines the corresponding length of the flight tube 40. Using currently available technology, the delay preferably lies in the range 5-10 ns. For example, for an average electron energy of 1 keV, 100 mm of uninterrupted flight length provides a delay of about 5 ns. This is an acceptable length for the delay line and the timescale is sufficient for currently available electronics to modulate specific electron packets. It is thus important to ensure that the gate is activated before any overly intense electron packet reaches it. In some embodiments, the attenuation rate conveniently may be such that the intensity modulation can be performed as a result of bit shift operations (i.e. attenuation by powers of 2).

Whenever, the voltage is applied to gate 50, the gate attenuates the electron packet passing through the gate by an attenuation factor (preferably in the range 2 to 20, more preferably 10 to 20). The attenuation factor can be related to the voltage applied to the gate during calibration of the instrument. Calibration itself could make use of isotopic distribution of calibrant molecules: isotopic ratios should remain correct within several percent for intense peaks. The data acquisition system 90 subsequently multiplies the second output by that attenuation factor if a gate voltage was applied (and by 1 if no voltage was applied). Alternatively, in other embodiments, the second output is sent from the data acquisition system to a downstream computer with an additional bit which indicates a presence or absence of the voltage on the gate, whereby the computer corrects the second output using the pre-calibrated attenuation factor.

The gate 50 could be operated either in analogue or digital manner. In analogue operation, attenuation of the electron packets may be arranged to be a function, e.g. monotonous function, of the voltage(s) on gate 50, with an optimum attenuation voltage chosen at a certain value by a calibration procedure. The advantage of analogue operation is the tunability of the attenuation factor while its main disadvantage is possible dependence of this factor on the intensity of incoming signal (as it affects energy and angular distributions of electrons via space charge effects). The embodiment shown in FIG. 1 is typically implemented with analogue operation. A digital operation is described in more detail below with reference to FIGS. 2 and 3.

An example of typical sensitivity and gain of the detection system is the following. To be reliably detected at a bandwidth of hundreds of MHz, the intercepted electron packet should preferably be detected at signal-to-noise ratio of at least 3, more preferably at least 5. Practically, this means that it should contain about at least 200,000 to 600,000 elementary charges, or about 30 to 100 femtoCoulombs. Then, the first output would be reliably amplified by amplifier 81 of control electronics 80, form a trigger pulse on comparator 82 and activate voltage switch 83 to transmit a voltage pulse to gate 50. If the sensitivity of the detection system is adjusted to detect incoming ion packets containing only a single ion, then even using high-dynamic range amplification stages 20 and 60 and a high-performance data acquisition system 90 (containing, e.g., a 10 or 12 bit ADC), the linear dynamic range may typically run out at a few hundreds of ions in a packet (e.g. at about 100 to 300 ions). A reliable operation of control electronics 80 preferably then requires that amplification of the first stage 20 should lie in a range about 1000 to 3000. Also, to keep each stage 20 or 60 within linear range, its maximum output should not exceed about $5\times10^7$ to $10^8$ electrons/pulse which limits the total gain of the detection system to about $5\times10^5$ electrons/ion, corresponding to the gain of the second amplification stage 60 of about 200 to 300. As a rule of thumb, a dynode of an electron multiplier works until about 1 to 5 Coulomb of charge is extracted from each square centimeter of its area. Therefore, about $10^{11}$ of maximum pulses could be detected before a change of multiplier would be required which in practice allows detection up to about $10^4$ to $10^5$ maximum pulses per second (which roughly amounts to about 1 to 10 intense pulses/shot for orthogonal acceleration TOF analyzers and about 100 to 1000 intense pulses/shot for multi-reflection TOF analyzers) for up to several weeks or months. The foregoing description is based upon currently available technology and such numbers may change as the performance of technology improves.

Preferably, the invention aims to attenuate amplification of intense pulses in the second stage in such a way that the output still stays below $5\times10^7$ to $10^8$ electrons/pulse in the worst possible case. Practically, ranges of normal and attenuated operation should overlap by at least factor of 3, or at least a factor of 5, so if each range covers dynamic range of 200 to 300, then the combined system could be capable of dynamic range 10,000 to 20,000 in a single spectrum and well over $10^6$ in a 1-second data acquisition time. This makes TOF analyzers compatible with 100% transmission of the entire ion flow coming from modern ion sources where it could reach $10^{10}$ ions/second.

As mentioned briefly above, the operation of gate 50 could be implemented either in analogue or digital manner. An analogue operation has been described with reference to FIG. 1. In one mode of digital operation, attenuation of the beam of electrons can be arranged to exhibit an abrupt drop as a function of the pulsed voltage(s) on gate 50, rather than vary as a monotonous function as in analogue operation. This can be achieved, for example, by dividing gate 50 into a plurality, e.g. a large number, of transmission channels (e.g. by arranging the gate as a mesh or dynode having openings or channels therethrough, i.e. a perforated dynode). The electrons may be let through a certain fraction of the channels (which may be either a small or large fraction) without any impediment and blocked from passing through other channels. The embodiment of FIG. 1 could be operated in this way with such a gate acting as gate 50.

Figure 2:
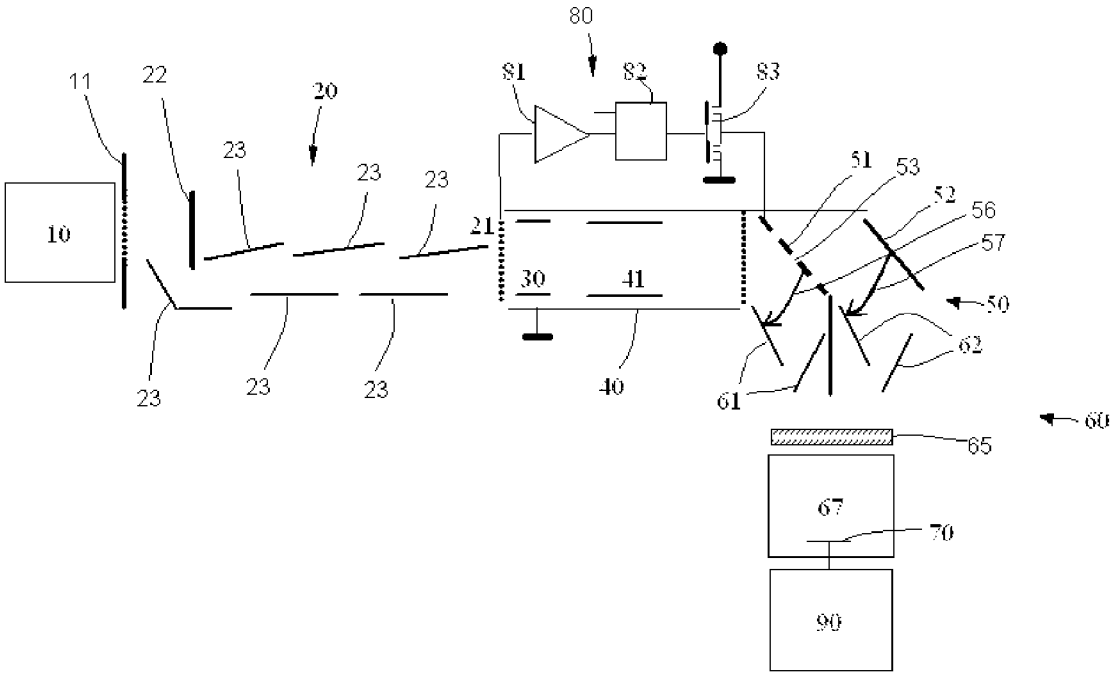
FIG. 2 shows schematically a second exemplary embodiment of a detection system and method according to the present invention comprising a low transmission gate.
Figure 3:
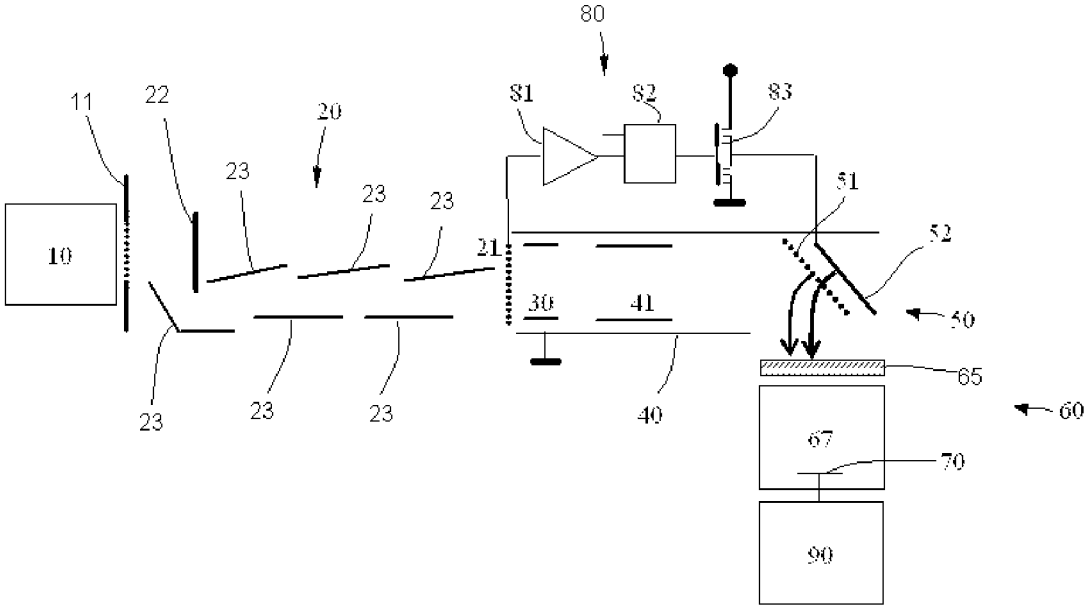
FIG. 3 shows schematically a third exemplary embodiment of a detection system and method according to the present invention comprising a high transmission gate.

Further preferred embodiments, particularly suited for digital operation, may be classified according to the design of the gate channels, as now described with reference to FIGS. 2 and 3.

Low-transmission gate channels: In FIG. 2 there is shown another embodiment of a detection system generally as shown in FIG. 1 up to the gate 50. Accordingly similar reference numerals refer to similar components. In the FIG. 2 embodiment the gate 50 is arranged by having small openings 53, preferably uniformly distributed, over the area of a first dynode 51 (perforated dynode), so that only a small proportion of all the electrons (e.g. 1-10%) in an electron packet pass through the channels and hit second dynode 52. By applying a positive voltage pulse to dynode 51, which voltage is applied by control electronics 80 based on the first output (in the same way as the control electronics 80 apply the voltage to the gate 50 in FIG. 1), secondary electrons 56 produced from dynode 51 can be restrained from going towards the set of one or more further dynode(s) 61 of the second amplification stage, thereby attenuating the electron packet. However, secondary electrons 57 produced from dynode 52 are always allowed to pass to their corresponding set of one or more further dynodes 62. The paths of the secondary electrons originating from dynode 51 and dynode 52 converge again upon scintillator 65 to produce a detection signal on anode 70 of photomultiplier 67 which is the second output from the system. The duration of electron transport and gain in dynode(s) 61, 62 may be adjusted to eliminate any mass peak shift or saturation of data acquisition system 90. The gate is in this embodiment operated digitally so that the voltage applied to dynode 51 abruptly stops the secondary electrons emitted from reaching further dynodes 61, i.e. either there is no attenuation (when no voltage is applied) or the attenuation of the electron packet is by a fixed attenuation factor corresponding to the loss of electrons from dynode 51 from the detected second output. However, if the attenuation voltage pulse applied to dynode 51 in FIG. 2 is not high enough, then a portion of the electrons at the higher energy tail of the electron distribution will still come through to the final detection and analog mode would thereby prevail.

High-transmission gate channels: In FIG. 3, there is shown yet another embodiment of a detection system again generally as shown in FIG. 1 up to the gate 50. In the FIG. 3 embodiment the gate 50 is arranged by again having small openings, preferably uniformly distributed, over the area of a first dynode 51 which this time has very high transmission (e.g. it is an electro-etched or electro-deposited grid) so that only a small proportion of all the electrons (e.g. 1-10%) hits it while all other electrons pass through and hit second dynode 52 which is located behind dynode 51, such that secondary electrons from dynode 52 can pass through the high transmission perforated dynode 51 to the next amplification stage 60. By applying a positive voltage pulse to dynode 52, which voltage is applied by control electronics 80 based on the first output (in the same way as the control electronics 80 apply the voltage to the gate 50 in FIG. 1), secondary electrons from it can be restrained from going through dynode 51 thereby attenuating the electron packet, so that only electrons from the front surface of dynode 51 would reach the second stage of amplification 60, which in the embodiment shown in FIG. 3 is the scintillator 65 and photomultiplier 67, and be detected. In a different embodiment, the high transmission dynode 51 and dynode 52 could be positioned similar to those in FIG. 2 so that secondary electrons from dynode 51 move through a dynode set 61 and secondary electrons from dynode 52 move through a dynode set 62 to ultimately converge on anode 70 and by applying a positive voltage pulse to dynode 52 secondary electrons from it can be restrained from going towards the dynode set 62, thereby attenuating the electron packet. The gate is in this embodiment also operated digitally so that the voltage applied to dynode 52 abruptly stops the secondary electrons emitted from being detected, i.e. either there is no attenuation (when no voltage is applied) or the attenuation of the electron packet is by a fixed attenuation factor corresponding to the loss of electrons from dynode 52 from the detected second output. However, if the attenuation voltage pulse applied to dynode 52 in FIG. 3 is not high enough, then a portion of the electrons at the higher energy tail of the electron distribution will still come through to the final detection and analog mode would thereby prevail.

Figure 4:
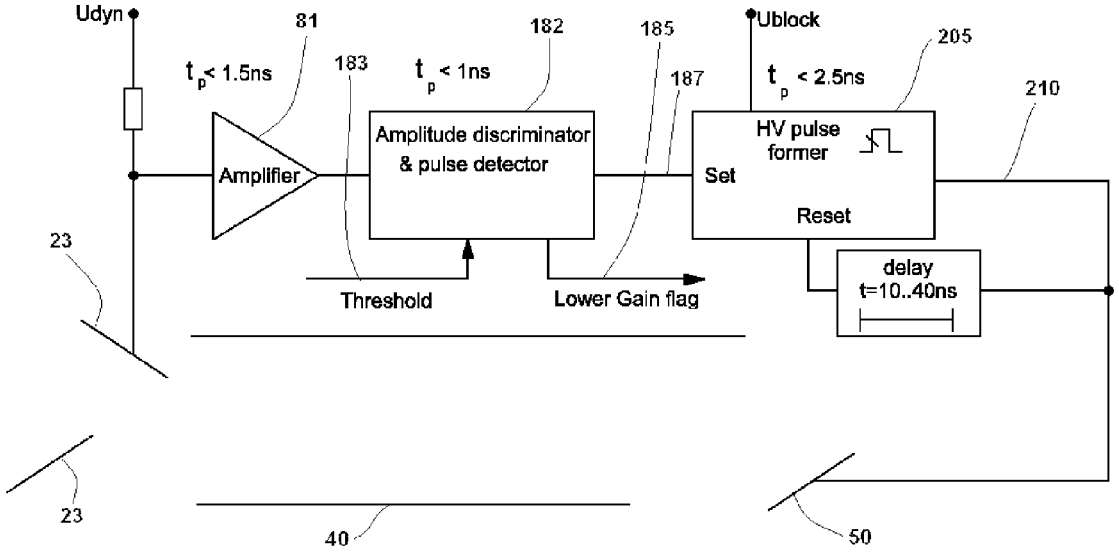
FIG. 4 shows schematically an exemplary embodiment of gating electronics for a detection system and method according to the present invention.

A preferred embodiment of the gating control electronics 80 is shown in FIG. 4 together with characteristic propagation delays $t_p$ through the components (i.e. times taken for the signal to traverse the components). Where applicable, the same reference numerals to those used in FIGS. 1 to 3 are used to denote the same components. In the example shown in FIG. 4, there is a further variation to the detection system in that the first output is taken from one of the dynodes 23, rather than the grid 21. Thus, grid 21 is not required in all embodiments. However, the first output could be taken from the grid 21 as described above with reference to FIG. 1. The electrical signal which is the first output is first fed to an amplifier 81. The amplifier 81 is a high speed OpAmp acting as a voltage amplifier or a current-to-voltage converter and has a $t_p$ of less than 1.5 ns typically. Next, an amplitude discriminator and pulse detector 182 receives the amplified first output and compares it to a threshold voltage or current 183 (depending on whether the amplified first output is a voltage or current). The amplitude discriminator and pulse detector 182 is thus a circuit based on one or more voltage or current comparators. The amplitude discriminator and pulse detector 182 could, for example, be a Constant Fraction Discriminator (CFD) or other device providing a digital pulse 187 if a signal above the threshold appears. The level of discrimination needed is thus set up by the threshold voltage or current 183. The amplitude discriminator and pulse detector 182 additionally gives a "Lower Gain" flag signal 185 for the data acquisition system (DAQ) 90 if the incoming signal exceeds the level of discrimination so that the DAQ can multiply the detected second output from the system by the appropriate attenuation factor. It may alternatively be possible for the attenuation of the signal to be detected by the DAQ from jumps in the data signal intensity, which could save the use of the lower gain flag. The amplitude discriminator and pulse detector 182 has a $t_p$ of less than 1 ns typically. A HV Pulse former 205 receives the digital pulse 187 from the amplitude discriminator and pulse detector 182 and in response produces a HV pulse 210 which is connected to the gate 50 (shown schematically in FIG. 4) to attenuate electrons passing the gate. The HV Pulse former 205 may be, for example, an HV monoflop based on avalanche and/or regenerative switches and produces HV pulses with sharp edges (<1 ns) and defined pulse duration (e.g. 10 to 40 ns). The HV Pulse former 205 has a $t_p$ of less than 2.5 ns typically. It can be seen therefore that the whole control electronics 80 has a total propagation delay $t_p$ from the input of the amplifier to the output of the HV pulse former less than 5 ns. In general, the whole control electronics 80 preferably has a total propagation delay $t_p$ from the input of the amplifier to the output of the HV pulse former less than 10 ns, more preferably less than 5 ns. In a variation of the foregoing, the output of the pulse former could be also capacitively coupled to gate 50, wherein the RC chain should be selected in such a way that rise- and fall-times of the pulse are not compromised, as known to those experienced in the art.

The gate 50 is optimally operated each time so as to attenuate an electron packet received at the gate for a duration which is typically not longer than the peak width of the electron packet at 10% of its peak height, and may be not longer than the peak width of the electron packet at 30% of its peak height. This typically allows the system to get back into the more sensitive (un-attenuated) mode when the electron intensity recedes. If the electron peak is still too intense after a pulse is applied, the next HV pulse will be formed and applied and so on. However, in some embodiments, the gate may be operated for a duration which is longer than this. The gate may be operated (energised by voltage pulse), i.e. each voltage pulse is applied, for a duration typically in the range 10 to 40 ns. However, in some embodiments, the gate may be operated for a duration which is shorter or longer than this, especially if operated by two or more pulses in succession. The data acquisition system or other data processing device then preferably multiplies the attenuated second output at all data points during the operation of the gate so that the second output from all attenuated electron packets are multiplied by the attenuation factor.

It can be seen that the present invention preferably can provide a detection system incorporating electronics that makes it possible to keep both the detector components and data acquisition system within their normal linear operation (normal dynamic range) by dynamically adjusting the effective amplification or gain inside a detection system having at least two stages of electron amplification. Dynamic adjusting of the gain is preferably implemented by picking-up of a first electron signal from a given packet of electrons as the output of a first amplification stage of an amplification system, directing the electrons along a delay line (e.g. a flight tube) with simultaneous switching on of a gate at the end of the delay line to attenuate the intensity of the same given electron packet if necessary based upon the first electron signal. After the gate, the electrons pass through further, second stage amplification and produce a detectable electron signal as a second output.

It is also feasible to provide an optical de-coupling between the first and second output, wherein electrons are converted to photons at or after the detection location of the first output, photons are transferred over an optical delay line (e.g. fibre optic of several meters long) to an optronic modulating device and then photons are converted into electrons by a photomultiplier employing e.g. either secondary electron emission or an avalanche diode or an array of diodes.

It will be appreciated that the detection system may be designed for the detection of either positive ions or negative ions, e.g. by appropriate changes of voltages applied to the components of the detection system.

Herein ions are used as an example of charged particles but the invention could equally be used with charged particles other than ions.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

What is claimed is:

1. A method of increasing a dynamic range of ion detection in mass spectrometry, comprising:

separating ions by time of flight;

detecting the separated ions using a two-stage detector;

wherein an output from a second stage of the two-stage detector is modulated using an output from a first stage of the two-stage detector to ensure that the output from the second stage does not reach a saturation level, wherein a delay between producing the outputs of the first and second stages is substantially less than 1 microsecond in duration.

2. The method of claim 1 wherein the delay between the outputs of the first and second stages is from 1 to 50 nanoseconds.

3. The method of claim 1 wherein the delay between the outputs of the first and second stages is from 1 to 10 nanoseconds.

4. The method of claim 1 wherein the delay between the outputs of the first and second stages is from 1 to 5 nanoseconds.

5. The method of claim 1 wherein the delay between the outputs of the first and second stages is from 5 to 10 nanoseconds.

6. The method of claim 1 wherein the delay between the outputs of the first and second stages is from 3 to 20 nanoseconds.

7. The method of claim 1 wherein the delay between the outputs of the first and second stages is from 5 to 50 nanoseconds.

8. The method of claim 1 wherein the delay is provided by a delay path between secondary particles leaving the first stage and entering the second stage.

9. A time-of-flight detector for detecting ions from an incoming ion beam, comprising:

a two-stage detector for detecting the ions;

wherein an output from a second stage of the two-stage detector is modulated using an output from a first stage of the two-stage detector to ensure that the output from a second stage does not reach a saturation level, wherein a delay between producing the outputs of the first and second stages is substantially less than 1 microsecond in duration.

10. The time-of-flight detector of claim 9 wherein the delay between the outputs of the first and second stages is from 1 to 50 nanoseconds.

11. The time-of-flight detector of claim 9 wherein the delay between the outputs of the first and second stages is from 1 to 10 nanoseconds.

12. The time-of-flight detector of claim 9 wherein the delay between the outputs of the first and second stages is from 1 to 5 nanoseconds.

13. The time-of-flight detector of claim 9 wherein the delay between the outputs of the first and second stages is from 5 to 10 nanoseconds.

14. The time-of-flight detector of claim 9 wherein the delay between the outputs of the first and second stages is from 3 to 20 nanoseconds.

15. The time-of-flight detector of claim 9 wherein the delay between the outputs of the first and second stages is from 5 to 50 nanoseconds.

16. The time-of-flight detector of claim 9 further comprising a delay path between particles leaving the first stage and particles entering the second stage that provides for the delay between the outputs of the first and second stages.

* * * * *